US005379501A

United States Patent [19]

Goineau

[11] Patent Number: 5,379,501

[45] Date of Patent: Jan. 10, 1995

[54] METHOD OF PRODUCE LOOP PILE YARN

[75] Inventor: André M. Goineau, Spartanburg, S.C.

[73] Assignee: Milliken Research Corporation, Spartanburg, S.C.

[21] Appl. No.: 99,284

[22] Filed: May 24, 1993

[51] Int. Cl.[6] ..... D02G 3/00; D02G 3/04

[52] U.S. Cl. ..... 28/281; 28/271; 57/6

[58] Field of Search ..... 28/271, 272, 281; 57/207, 208, 245, 246, 247, 287, 333, 350, 362, 908

[56] References Cited

U.S. PATENT DOCUMENTS

| | | | |
|---|---|---|---|
| 3,410,077 | 11/1968 | Marzocchi et al. | 28/271 X |
| 3,457,715 | 7/1969 | Eldridge et al. | 28/271 X |
| 3,763,640 | 10/1973 | Nagel et al. | 57/6 |
| 3,918,244 | 11/1975 | Drummond | 57/6 |
| 3,940,917 | 3/1976 | Strachan | 28/271 X |
| 4,145,869 | 3/1979 | Duncan et al. | 28/271 X |
| 4,296,597 | 10/1981 | Tani et al. | 57/6 X |
| 4,341,063 | 7/1982 | Southerlin et al. | 28/271 X |
| 4,437,301 | 3/1984 | Eschenbach et al. | 28/271 X |
| 4,567,720 | 2/1986 | Price | 28/271 X |

FOREIGN PATENT DOCUMENTS

| | | | |
|---|---|---|---|
| 673077 | 10/1963 | Canada | 28/271 |
| 0028212 | 6/1987 | Japan | 28/271 |

*Primary Examiner*—Clifford D. Crowder
*Assistant Examiner*—John J. Calvert
*Attorney, Agent, or Firm*—Terry T. Moyer; Earle R. Marden

[57] ABSTRACT

A method to provide a looped pile yarn having a high number of loops projecting therefrom. The yarn is produced by drawing and texturing a core and effect yarn with the effect yarn being supplied to the air texturing jet with a high overfeed in the range of 100–200%.

3 Claims, 1 Drawing Sheet

METHOD OF PRODUCE LOOP PILE YARN

This invention relates to a method to produce a loopy yarn from two continuous filament, synthetic yarns. One yarn will be a core yarn and the other yarn will be the effect yarn which provides the looped look to the yarn.

It is, therefore, an object of the invention to provide a method to produce a looped yarn from at least two continuous filament, synthetic yarns.

Other objects and advantages of the invention will become readily apparent as the specification proceeds to describe the invention, with reference to accompanying drawing, in which.

In the preferred form of the invention the loopy yarn 54 (FIG. 1) consists of core yarns 10 and effect yarns 14 with the effect yarns 14 being supplied at a rate substantially higher than the core yarns in the texturizing process to produce the loops 53. A large number of loops 53 are desired when the yarn 54 is employed as the female connecting portion of a female fabric in a hook and loop connection.

Figure 1:
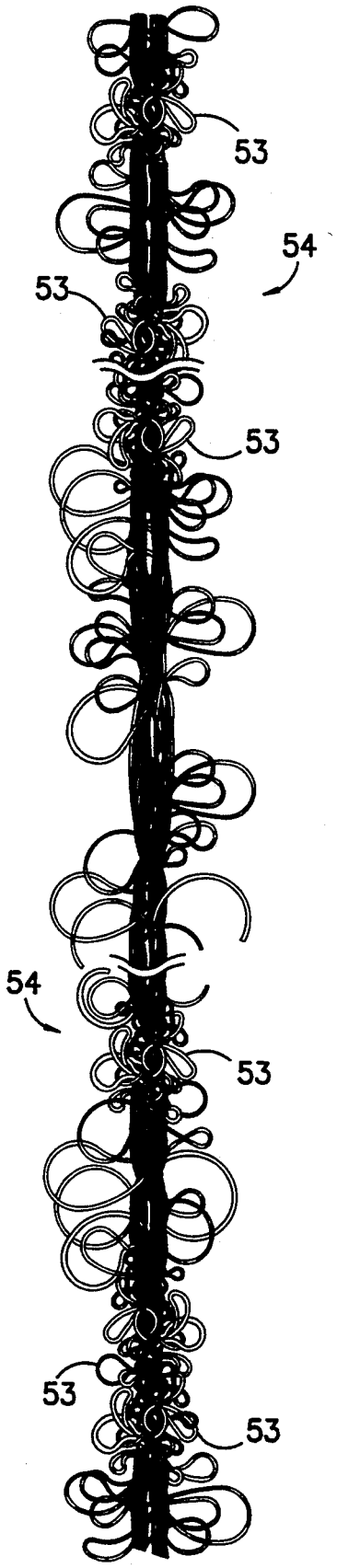
FIG. 1 is a drawing of the yarn made by the disclosed process.
Figure 2:
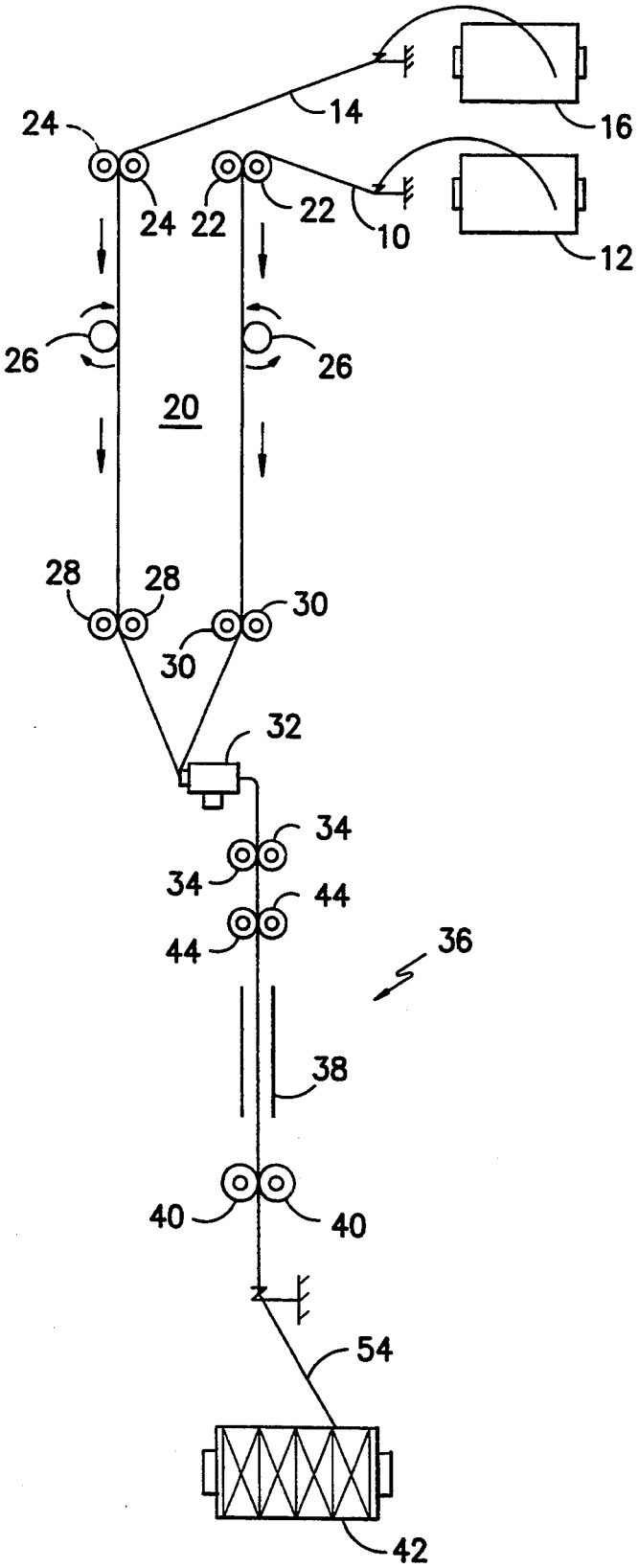
FIG. 2 is a schematic representation of the method to produce the yarn.

FIG. 2 illustrates the preferred method of producing the yarn 54 of FIG. 1. The core yarn 10 from the package 12 and the effect yarn 14 from the package 16 are both DuPont 255 denier, 34 filament—56T polyester yarn which are drawn in the draw zone 20. The core yarn feed rolls 22 are driven at a speed of 666 rpm while the effect yarn feed rolls 24 are driven at a speed of 1558 rpm. The effect yarns 14 and the core yarns 10 are drawn in the draw zone 20 as they are drawn around the hot pins 26 (200° C.) by the respective draw rolls 28 and 30. The draw rolls 28 for the effect yarn 14 are driven at a rate of 2619 rpm while the rate of the draw rolls 30 for the core yarn 10 is 1119 rpm. The core and effect yarns are brought together at the entrance to the air jet 32, operating at a pressure of 145 psi, and commingled and textured therein to produce the yarn 54 shown in FIG. 1.

To produce the desired number of loops 53 from the effect yarn 14 the speeds of the draw rolls 28 and 30 along with the speed of the yarn withdrawing rolls 34 to provide an overfeed of the effect yarn 14 in the range of 100 to 200%. In the preferred form of the invention the speed of the rolls 34 is 1048 rpm to provide an overfeed of 150% in accordance with the formula:

$$\text{Overfeed } \% = \frac{\text{(Speed of the effect yarn draw rolls)} - \text{(Speed of the withdrawal of rolls)}}{\text{Speed of the withdrawal rolls}} \times 100$$

In conventional manner the looped textured and entangled yarn 54 from the jet 32 passes through the stabilization zone 36, the post heater 38 and take-up rolls 40 to the take-up roll or package 42. To allow the yarn 54 from the jet 34 to stabilize the rolls 44 are driven at a rate of 1051 rpm while the delivery rolls 40 are driven at a rate of 1050rpm.

As briefly discussed the loopy yarn produced by the invention is basically designed to be used on a fabric or article where the loops of the yarn provide the hook engaging member for a female fabric or material of a hook and loop connection. To obtain maximum grabbing force between the hooks and the loops it is desired to provide a large number of loops in the yarn. The disclosed invention with the high overfeed of the effect yarn provides the desired number of loops to effectively co-act with the hooks of the connector. As disclosed it is necessary for the overfeed to be at least 100% with the preferred upper limit being about 200%.

Although the preferred embodiments of the invention have been described in detail it is contemplated that many changes may be made without departing from the scope of the invention and it is, therefore, desired that the invention be limited only by the claims.

I claim:

1. A method of producing a looped yarn comprising the steps of: supplying multifilament, partially oriented, non-textured synthetic core and effect yarns, drawing said core and effect yarns, supplying said drawn core and effect yarns directly into an air entangling and texturing jet via core and effect draw rolls, supplying the jet with air at a pressure in excess of 100 psi, entangling and texturing the core and effect yarns in the air jet, withdrawing the entangled and textured yarn from the air jet via withdraw rolls and taking up the textured yarn; wherein, the effect yarn is supplied by the effect draw rolls with an overfeed of 100–200% with respect to the withdraw rolls so as to produce a yarn having numerous loops projecting therefrom.

2. The method of claim 1 wherein the effect yarn overfeed is about 50%.

3. The method of claim 2 wherein said core and effect yarns are polyester.

* * * * *